US008387404B2

(12) United States Patent
Choi et al.

(10) Patent No.: US 8,387,404 B2
(45) Date of Patent: Mar. 5, 2013

(54) AIR CONDITIONER

(75) Inventors: In Ho Choi, Seoul (KR); Jong Chan Park, Seoul (KR); Han Lim Choi, Seoul (KR); Dong Whan Choi, Seoul (KR); Nam Sik Yim, Seoul (KR)

(73) Assignee: LG Electronics Inc., Seoul (KR)

( * ) Notice: Subject to any disclaimer, the term of this patent is extended or adjusted under 35 U.S.C. 154(b) by 711 days.

(21) Appl. No.: 12/641,630

(22) Filed: Dec. 18, 2009

(65) Prior Publication Data

US 2010/0175397 A1 Jul. 15, 2010

(30) Foreign Application Priority Data

Jan. 9, 2009 (KR) ..... 10-2009-0001988

(51) Int. Cl.

| | |
|---|---|
| ***F25B 49/00*** | (2006.01) |
| ***F25D 17/04*** | (2006.01) |
| ***F24F 7/00*** | (2006.01) |
| ***G01M 1/38*** | (2006.01) |

(52) U.S. Cl. ..... 62/132; 62/186; 62/408; 454/292; 700/276

(58) Field of Classification Search ..... 62/132, 62/408, 186, 404; 165/237; 700/276; 454/292
See application file for complete search history.

(56) References Cited

U.S. PATENT DOCUMENTS

| | | | |
|---|---|---|---|
| 7,185,504 | B2 | 3/2007 | Kasai |
| 2006/0168862 | A1 | 8/2006 | Kim |

FOREIGN PATENT DOCUMENTS

| | | | |
|---|---|---|---|
| JP | 7151370 | A | 6/1995 |
| JP | 2007322118 | A | 12/2007 |
| KR | 100295964 | B1 | 10/2001 |
| KR | 100761768 | B1 | 9/2007 |

OTHER PUBLICATIONS

International Search Report issued in PCT/KR2009/007455, mailed Apr. 15, 2010, 3 pages.

*Primary Examiner* — Chen Wen Jiang
(74) *Attorney, Agent, or Firm* — Fish & Richardson P.C.

(57) ABSTRACT

An air conditioner includes a cabinet positioned on an indoor ceiling. The air conditioner also includes a front panel that is coupled to the cabinet and has an air inlet. The air conditioner further includes a suction panel coupled to the front panel and configured to move to open or close the inlet. In addition, the air conditioner includes a sensor unit positioned on the suction panel, configured to detect a position of an indoor person, and configured to move downward with respect to the suction panel in response to an operation instruction.

20 Claims, 3 Drawing Sheets

AIR CONDITIONER

CROSS-REFERENCE TO RELATED APPLICATIONS

The present application claims the benefits of priority to Korean Patent Application No. 10-2009-0001988 (filed on Jan. 9, 2009), which is hereby incorporated by reference in its entirety.

FIELD

The present disclosure relates to an air conditioner.

BACKGROUND

Generally, an air conditioner, which is an apparatus for heating or cooling air using a refrigerant cycle, is sorted into a household air conditioner and an industrial air conditioner.

The household air conditioner may include into a separate type air conditioner in that an indoor unit and an outdoor unit are separated and an integrated type air conditioner in that an indoor unit and an outdoor unit are combined. The indoor unit of the separate type air condition can be a wall mounted type indoor unit that is mounted on a wall, a standing type indoor unit that is mounted on a bottom part, and a ceiling type (or cassette type) indoor unit that is mounted on a ceiling.

A structure where an Infra-Red (IR) sensor or a Pyroelectric Infra-Red (PIR) sensor, etc., is mounted on one side of the indoor unit to concentratedly supply cool air or warm air to a space in which indoor residents are positioned has been disclosed.

SUMMARY

In one aspect, an air conditioner includes a cabinet. The air conditioner also includes a front panel coupled to the cabinet and having an inlet. The air conditioner further includes a suction panel coupled to the front panel and configured to move between an open position in which air is able to circulate through the inlet of the air conditioner and a closed position in which air is obstructed from circulating through the inlet of the air conditioner. In addition, the air conditioner includes a sensor unit positioned on the suction panel, configured to detect a position of an indoor person, and configured to move downward with respect to the suction panel in response to an operation instruction.

Implementations may include one or more of the following features. For example, the air conditioner further may include an elevation unit configured to provide a driving force to the sensor unit in response to the operation instruction. The elevation unit may include a driving motor configured to generate a driving force to move the sensor unit. The elevation unit further may include a transfer unit configured to convert a rotation movement generated by the driving motor into a straight movement to move the sensor unit.

In some implementations, the air conditioner further may include a guiding part configured to guide movement of the sensor unit. The sensor unit may include a case and a sensor cover coupled to the case. The sensor unit also may include a sensing element configured to detect the position of the indoor person. The sensor cover of the sensor unit may be projected from the suction panel in response to the operation instruction. The air conditioner further may include a hole defined in the suction panel that enables the sensor unit to move through the suction panel in response to the operation instruction.

In some examples, the sensor unit may be sequentially moved relative to the suction panel when the suction panel is moved. The sensor unit may be simultaneously moved relative to the suction panel when the suction panel is moved.

In another aspect, an air conditioner includes a cabinet. The air conditioner also include a front panel coupled to the cabinet and having an inlet. The air conditioner further includes a suction panel coupled to the front panel and configured to move between an open position in which air is able to circulate through the inlet of the air conditioner and a closed position in which air is obstructed from circulating through the inlet of the air conditioner. In addition, the air conditioner includes a sensor unit positioned on the suction panel and configured to detect a position of an indoor person, wherein at least a portion of the sensor unit is configured to project from the suction panel in response to an operation instruction.

Implementations may include one or more of the following features. For example, the air conditioner further may include an elevation unit configured to provide a driving force to the sensor unit in response to the operation instruction. The elevation unit further may include a driving motor configured to generate a driving force to move the sensor unit and a transfer unit configured to transfer the driving force generated by the driving motor to the sensor unit.

In some examples, a sensor cover of the sensor unit may be projected from the suction panel in response to the operation instruction. The air conditioner further may include a guiding part configured to guide movement of the sensor unit. The sensor unit may be sequentially moved relative to the suction panel when the suction panel is moved.

In yet another aspect, an air conditioner includes a cabinet. The air conditioner also includes a front panel coupled to the cabinet and having an inlet. The air conditioner further includes a suction panel coupled to the front panel and configured to move between an open position in which air is able to circulate through the inlet of the air conditioner and a closed position in which air is obstructed from circulating through the inlet of the air conditioner. In addition, the air conditioner includes a sensor unit positioned on the suction panel, configured to detect a position of an indoor person, and configured to move downward in response to an operation instruction, wherein the movement of the sensor unit is separate from the movement of the suction panel.

Implementations may include one or more of the following features. For example, the air conditioner further may include an elevation unit configured to provide a driving force to the sensing unit in response to the operation instruction. At least a portion of the sensor unit is projected from the suction panel in response to the operation instruction. The air conditioner further may include a guiding part configured to guide movement of the sensor unit.

DETAILED DESCRIPTION

Figure 1:
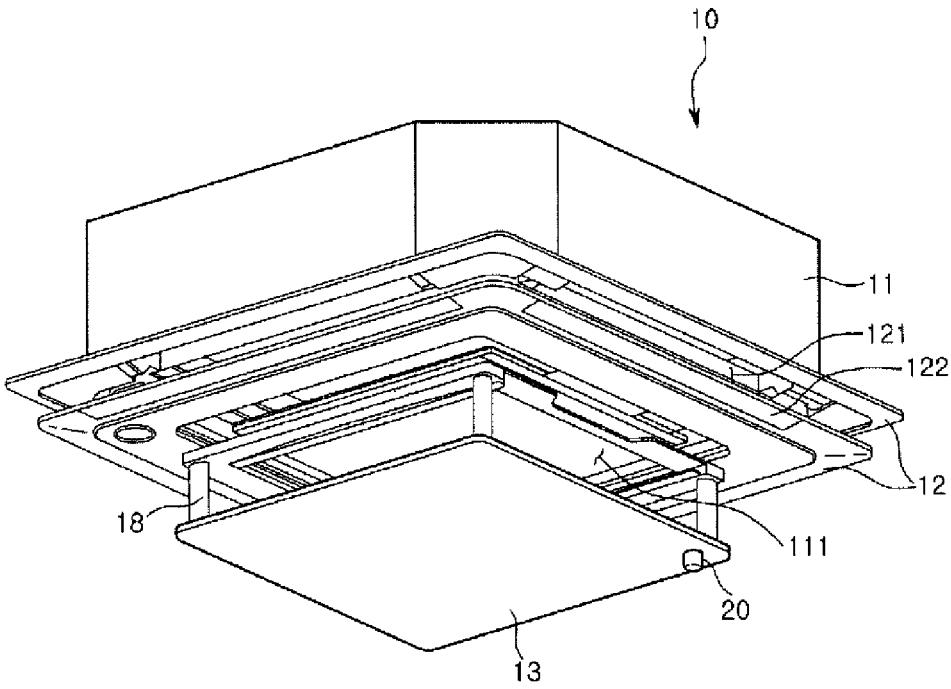
FIG. 1 is a perspective view of a ceiling type air conditioner.
Figure 2:
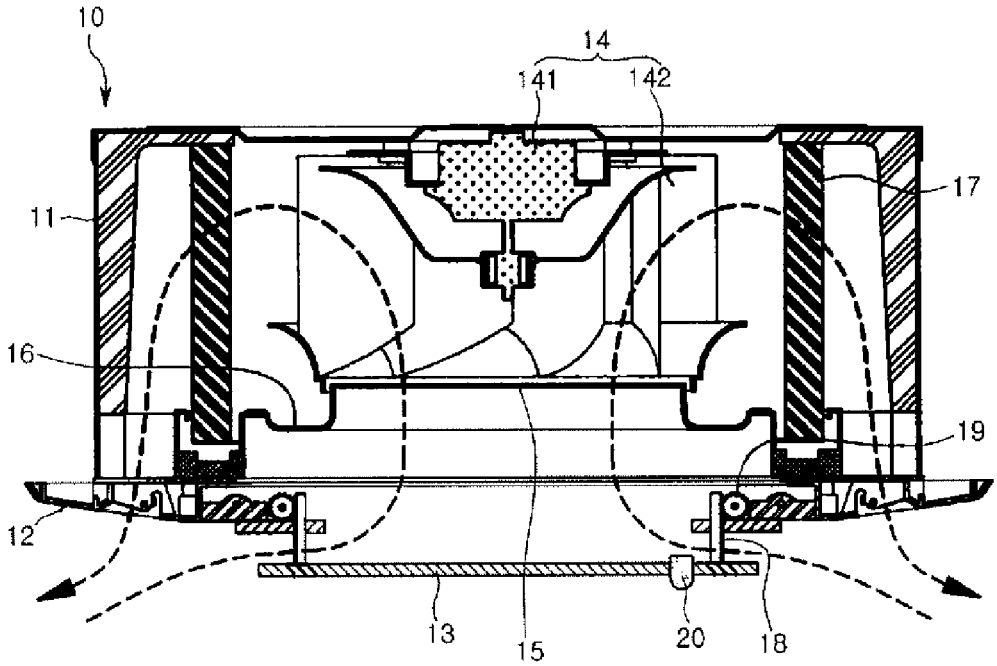
FIG. 2 is a longitudinal cross-sectional view schematically showing an inner configuration of the the air conditioner in FIG. 1.

Referring to FIGS. 1 and 2, an a ceiling type air conditioner having an indoor unit 10 includes a cabinet 11 that defines an external appearance, a front panel 12 that is coupled to a lower end of the cabinet 11, a suction panel 13 that is elevatably coupled from the front panel 12, a heat exchanger 17 that is enclosed around an inner side of the cabinet 11, a fan assembly 14 that is positioned in an inner side space of the heat exchanger 17, a shroud 16 that is positioned at a lower side of the fan assembly 14 to guide a flow of the sucked air, a filter 15 that is positioned on an upper end of the shroud 16 to purify the sucked air; and a sensor unit 20 that is mounted on one side of the suction panel 13 to detect a position and movement of indoor residents. The sensor unit 20 may be an Infra-Red sensor using infrared rays.

In detail, an edge part of the front panel 12 has four outlets 121 and each outlet 121 has a discharge vane 122. The direction of the air is adjusted or controlled based on the rotation angle of the discharge vane 122. When a position of indoor resident is detected by the sensor unit 20, the rotation angle of the discharge vane 122 is controlled by a controller to provide air inside of the indoor unit 10 to the resident.

In addition, the central part of the front panel 12 has an inlet 111 for sucking the indoor air and the inlet 111 is selectively shielded by the suction panel 13. A plurality of racks 18 are extended to the upper surface of the suction panel 13. A pinion 19 that is positioned on a uppserside of the front panel 12 is coupled to the rack 18 and a driving motor The driving motor provides the pinion 19 a drive force to rotate. Therefore, the suction panel 13 can move a predetermined distance between the upper and lower positions based on the operations of the rack 18 and pinion 19. The inlet 111 is selectively opened and closed by the movement of the suction panel 13. It is noted that the moving or driving unit of the suction panel 13 is not limited to the foregoing rack/pinion structure.

In addition, air that includes foreign materials sucked through the inlet 111 is filtered by passing through the filter 15 and the filtered air is sucked toward the fan assembly 14. The fan assembly 14 includes a centrifugal fan 142 and a fan motor 141 for driving the centrifugal fan 142. The centrifugal fan 142 is configured to direct air flow from a suction part of the air conditioner to radial discharge parts of the air conditioner as shown in FIG. 2. As such, the air sucked by the fan assembly 14 passes through the heat exchanger 17 and is then discharged to an indoor area through the outlet 121.

In some examples, the sensor unit 20 is positioned on the suction panel 13 and its position may be mounted on one side edge of the suction panel 13 as shown in FIGS. 1 and 2. Alternatively, the sensor unit 20 may be positioned on the central part of the suction panel 13. If a sensor unit 20 is positioned on one side of the front panel 12, the suction panel 13 can serve as an obstacle because the suction panel 13 is located at a lower position than the sensor's position when the ceiling type air conditioner is operating. In other words, the infrared rays sent from the sensor unit 20 impinge on the suction panel 13, such that the sensor unit 20 cannot detect a position of a person in a room. However, if the sensor unit 20 is positioned on the suction panel 13, the above mentioned obstacle may be reduced. As a result, the phenomenon of limiting the sensing range due to the moving suction panel 13 may be reduced.

Further, as radiating infrared rays are received by inside the sensor unit 20, the sensing element of the sensor unit 20 can rotate 360° by a driving unit. The configuration and operation of the sensor unit 20 will be described with reference to FIGS. 3 and 4.

Figure 3:
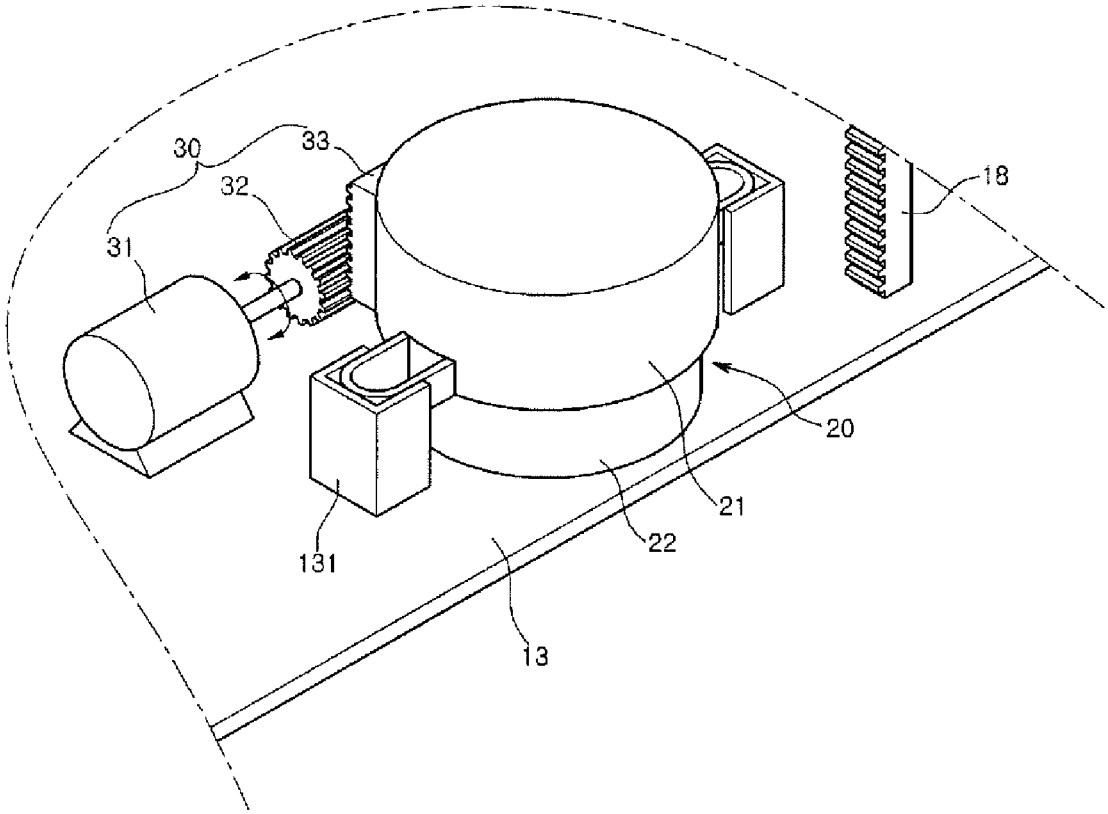
FIG. 3 is a perspective view showing an example of a sensor unit is mounted on an upper surface of a suction panel.
Figure 4:
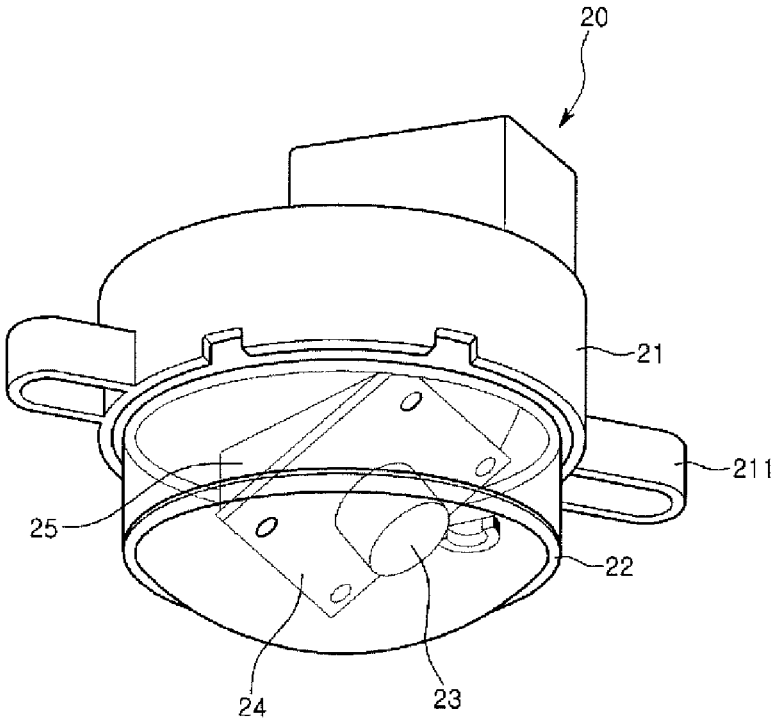
FIG. 4 is a perspective view of the sensor unit.

Referring to FIGS. 3 and 4, the sensor unit 20 includes a case 21, a sensor cover 22 coupled to the lower end of the case 21, and a detecting unit that is located inside of a chamber defined by the case 21 and the sensor cover 22.

The sensor unit 20 is positioned on the suction panel 13 and is moved upward and downward. For example, the sensor unit 20 may move down from the upper surface of the suction panel 13 in response to an operation instruction (e.g., power on). Also, the sensor unit moves up to return to the original position which is the upper surface of the suction panel in response to an operation instruction (e.g., power off). In this implementation, the suction panel 13 has a hole through which the sensor cover 22 penetrates. Therefore, the sensor cover 22 is moved or descended through the hole of the suction panel 13 by the elevation unit 30. For example, when a user inputs an operation instruction of the sensor unit 20(e.g., power on the air conditioner), the elevation unit 30 provides a driving force to the sensor unit 20. The sensor cover 22 of the sensor unit 20 is projected from the lower end of the suction panel 13 based on the driving force. And when the projection of the sensor cover 22 is completed, the detecting unit that is, for example, the sensing element 23 of the sensor unit 20 is positioned inside of the sensor cover 22 and starts a detection operation of a person in a room.

The upper surface of the suction panel 13 may have a guide part 131 that guides the elevation operation of the sensor unit 20 such as moving downward or upward of the sensor unit 20. The elevation unit 30 provides the sensor unit 20 the driving force for the elevation operation of the sensor unit 20. The elevation unit 30 includes a rack that is positioned on one side of the outer circumferential surface of the sensor unit 20, a pinion 32 that is gear-coupled with the rack 33, and a driving motor 31 that provides a rotation force to the pinion 32. With the above configuration, based on the rotating force generated by the driving motor 31, the pinion 32 may be rotated. The rack 33 coupled to the pinion 32 is then moved upward or downward.

As a result, the sensor unit 20 moves upward or downward in response to movement of the pinion 32. When the air conditioner is powered on, the sensor unit 20 is moved downward in connection with downward movement of the pinion 32. Also, when the air conditioner is powered off, the sensor unit is moved upward in connection with upward movement of the pinion 32. Herein, the rack 33 may be configured not to be exposed to the outside when the sensor cover 22 completely descends. The suction panel 13 may visually block the elevation unit including the rack 33.

Figure 5:
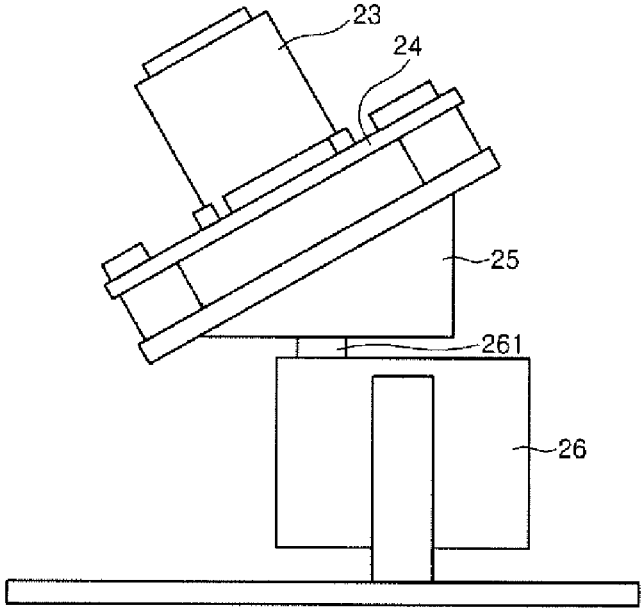
FIG. 5 is a side view schematically showing a configuration of a detecting unit.

A configuration or structure of the elevating unit 30 having the driving motor 31, the pinion 32, and the rack 33 may be modified to be able to perform the elevation operation of the sensor unit 20. In some examples, a transfer unit, which can convert the rotation movement of the rotation force generated from the driving motor 31 into a straight reciprocal movement in an up and down direction, can be included within the present disclosure. The sensor unit 20 may be moved by an electromagnet that pushes or pulls the sensor unit 20 based on selectively supplying electricity to the electromagnet. Referring to FIGS. 4 and 5, the sensor unit 20 includes a case 21 that connects a part of the detecting unit and a sensor cover 22 that is coupled to the lower end of the case 21. A bracket 211 is extended to the outer circumference of the case 21. The movement of the bracket 211 is guided by the guide part 131. The guide part 131 is positioned on the upper surface of the suction panel 13. The sensor cover 22 is defined in a cylindrical shape and its bottom surface has a convexly curved shape, having a predetermined curvature. The bottom surface of the sensor cover 22 is convexly curved, such that the refraction of the signal radiated from the detecting unit is reduced (e.g., minimized). The sensor cover 22 can be made of opaque materials and has a thickness that can easily transmit the infrared signal radiated from the detecting unit. For example, the sensor cover 22 is formed of opaque materials, such that the indoor resident does not misunderstand the sensor as a surveillance camera. The sensor can transmit most infrared signals to easily detect the indoor resident. Only the convex bottom part of the sensor cover 22 may be exposed to the indoor.

The detecting unit includes a sensing element 23 that radiates the sensing signals such as infrared rays, a circuit board 24 coupled to the sensing element 23 and has circuits for the operation of the sensor unit mounted thereon, a supporter 25 that supports the circuit board 24, and a driving motor 26 that is connected to the lower side of the supporter 25 to rotate the supporter 25.

In addition, the rotation shaft 261 of the driving motor 26 is connected to the lower end of the supporter 25. The upper surface of the supporter 25 is connected to the circuit board 24 and configured to be inclined at a predetermined angle as shown in FIG. 5. Therefore, the sensing element 23 can rotate 360° at the state inclined at a predetermined angle from a vertical line, such that the sensing range is extended. The sensing element 23 is mounted to be inclined from a vertical line, such that the bottom surface of the sensor cover 22 is defined in a convexly curved shape, thereby making it possible to reduce (e.g., minimize) the refraction phenomenon of the infrared signals radiated from the sensing element 23. For example, the infrared rays radiated from the sensing element 23 are orthogonal to a tangential line that passes through the bottom surface of the sensor cover 22 corresponding to a point through which the infrared rays pass, such that the signals radiated from the sensing element 23 can effectively transmit the sensor cover 22.

The driving motor 26 may be a step motor that can rotate forward or reversely and the sensing element 23 also rotates 360° forward and then rotates 360° reversely by the forward/reverse rotation of the driving motor 26.

If an operation instruction of the indoor unit 10 is provided to the sensor unit 20, the driving motor 26 can rotate in a forward direction and then rotate in a reverse direction at a predetermined time interval. For example, the driving motor rotates in a forward direction at a predetermined speed and then rotates in a reverse rotation at the same speed. The driving motor performs the forward direction and the reverse rotation after the predetermined time elapses. The sensing signal is transmitted from the sensing element 23 and returned to the sensing element reflected by a person in the room, thereby detecting the position of the residents in the indoor or space. The sensing element 23 can detect the position or movement of the resident as well as detect heat radiated from the resident, making it possible to detect the state of the resident by the controller. For example, in the heating mode, if the heat radiated from the resident is lower than a reference value stored in the memory of the controller, it is determined that the resident feels a chill, thereby making it possible to control the rotation angle of the discharge vane 122 to provide heated air to the resident.

When a cooling or heating operation instruction is inputted by the user, the suction panel 13 descends to open the inlet 111. The sensor unit 20 descends simultaneously with the descending of the suction panel 13 or descends after the suction panel 13 descends, such that the sensor unit is exposed to the indoor. The sensing element 23 implemented as the detecting unit detects a position and movement of an indoor resident while the sensing element 23 is rotating clockwise or counterclockwise. An amount of rotation of the discharge vane 122 is controlled based on a result of the detection. Air discharged from the indoor unit through the discharge vane 122 can be supplied to the resident. The sensing element 23 starts a sensing operation after the downward movement of the sensor unit 20 is completed or when the downward movement of the sensor unit 20 is in progress.

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. An air conditioner, comprising:
a cabinet;
a front panel coupled to the cabinet and having an inlet;
a suction panel coupled to the front panel and configured to move between an open position in which air is able to circulate through the inlet of the air conditioner and a closed position in which air is obstructed from circulating through the inlet of the air conditioner; and
a sensor unit positioned on the suction panel, configured to detect a position of an indoor person, and configured to move downward with respect to the suction panel in response to an operation instruction.

2. The air conditioner of claim 1, further comprises:
an elevation unit configured to provide a driving force to the sensor unit in response to the operation instruction.

3. The air conditioner of claim 2, wherein the elevation unit comprises:
a driving motor configured to generate a driving force to move the sensor unit.

4. The air conditioner of claim 3, wherein the elevation unit further comprises:
a transfer unit configured to convert a rotation movement generated by the driving motor into a straight movement to move the sensor unit.

5. The air conditioner of claim 1, further comprising:
a guiding part configured to guide movement of the sensor unit.

6. The air conditioner of claim 1, wherein the sensor unit comprises:
a case;
a sensor cover coupled to the case; and
a sensing element configured to detect the position of the indoor person.

7. The air conditioner of claim 6, wherein the sensor cover of the sensor unit is projected from the suction panel in response to the operation instruction.

8. The air conditioner of claim 1, further comprising:
a hole defined in the suction panel that enables the sensor unit to move through the suction panel in response to the operation instruction.

9. The air conditioner of claim 1, wherein the sensor unit is sequentially moved relative to the suction panel when the suction panel is moved.

10. The air conditioner of claim 1, wherein the sensor unit is simultaneously moved relative to the suction panel when the suction panel is moved.

11. An air conditioner, comprising:
a cabinet;
a front panel coupled to the cabinet and having an inlet;
a suction panel coupled to the front panel and configured to move between an open position in which air is able to circulate through the inlet of the air conditioner and a closed position in which air is obstructed from circulating through the inlet of the air conditioner; and a sensor unit positioned on the suction panel and configured to detect a position of an indoor person, wherein at least a portion of the sensor unit is configured to project from the suction panel in response to an operation instruction.

12. The air conditioner of claim 11, further comprising:

an elevation unit configured to provide a driving force to the sensor unit in response to the operation instruction.

13. The air conditioner of claim 12, wherein the elevation unit further comprises:

a driving motor configured to generate a driving force to move the sensor unit; and a transfer unit configured to transfer the driving force generated by the driving motor to the sensor unit.

14. The air conditioner of claim 11, wherein a sensor cover of the sensor unit is projected from the suction panel in response to the operation instruction.

15. The air conditioner of claim 11, further comprising:

a guiding part configured to guide movement of the sensor unit.

16. The air conditioner of claim 11, wherein the sensor unit is sequentially moved relative to the suction panel when the suction panel is moved.

17. An air conditioner, comprising:

a cabinet;

a front panel coupled to the cabinet and having an inlet;

a suction panel coupled to the front panel and configured to move between an open position in which air is able to circulate through the inlet of the air conditioner and a closed position in which air is obstructed from circulating through the inlet of the air conditioner; and a sensor unit positioned on the suction panel, configured to detect a position of an indoor person, and configured to move downward in response to an operation instruction, wherein the movement of the sensor unit is separate from the movement of the suction panel.

18. The air conditioner of claim 17, further comprising:

an elevation unit configured to provide a driving force to the sensing unit in response to the operation instruction.

19. The air conditioner of claim 17, wherein at least a portion of the sensor unit is projected from the suction panel in response to the operation instruction.

20. The air conditioner of claim 17, further comprising:

a guiding part configured to guide movement of the sensor unit.

* * * * *